US010682545B2

(12) United States Patent
Zelbst et al.

(10) Patent No.: US 10,682,545 B2
(45) Date of Patent: Jun. 16, 2020

(54) FRONT LEANING REST PLATFORMS AND USE THEREOF

(71) Applicant: Sam Houston State University, Huntsville, TX (US)

(72) Inventors: Pamela J. Zelbst, Huntsville, TX (US); Tara Troianello, Spring Lake, NC (US); Scott Golightly, The Woodlands, TX (US)

(73) Assignee: Sam Houston State University, Huntsville, TX (US)

( * ) Notice: Subject to any disclaimer, the term of this patent is extended or adjusted under 35 U.S.C. 154(b) by 140 days.

(21) Appl. No.: 15/909,411

(22) Filed: Mar. 1, 2018

(65) Prior Publication Data

US 2018/0250547 A1 Sep. 6, 2018

Related U.S. Application Data

(60) Provisional application No. 62/466,466, filed on Mar. 3, 2017.

(51) Int. Cl.

| | |
|---|---|
| ***A63B 21/00*** | (2006.01) |
| ***A63B 21/16*** | (2006.01) |
| ***A63B 23/12*** | (2006.01) |
| ***A63B 21/068*** | (2006.01) |
| *A63B 21/072* | (2006.01) |

(52) U.S. Cl.

CPC ..... *A63B 21/4035* (2015.10); *A63B 21/068* (2013.01); *A63B 21/16* (2013.01); *A63B 23/1236* (2013.01); *A63B 21/00047* (2013.01); *A63B 21/0724* (2013.01)

(58) Field of Classification Search

CPC ... A63B 21/068; A63B 21/0724; A63B 21/16; A63B 21/4035; A63B 21/00047; A63B 21/072; A63B 23/1236; A63B 22/16; A63B 22/20

See application file for complete search history.

(56) References Cited

U.S. PATENT DOCUMENTS

| | | | | |
|---|---|---|---|---|
| 8,317,666 | B2 * | 11/2012 | Wang | A63B 21/0605 482/106 |
| 8,353,808 | B1 * | 1/2013 | Barney | A63B 22/203 482/132 |
| 9,067,104 | B1 * | 6/2015 | Kim | A63B 22/20 |
| 9,630,045 | B1 * | 4/2017 | Martin, Sr. | A63B 21/0726 |
| 9,993,685 | B2 * | 6/2018 | Stevens | A63B 22/20 |
| 10,086,225 | B2 * | 10/2018 | Sheppard | A63B 21/0722 |
| 2014/0135186 | A1 * | 5/2014 | Reynolds | A63B 21/0726 482/108 |
| 2015/0105224 | A1 * | 4/2015 | Odneal | A63B 21/0726 482/107 |

* cited by examiner

*Primary Examiner* — Megan Anderson

(74) *Attorney, Agent, or Firm* — Kowert, Hood, Munyon, Rankin & Goetzel, P.C.; Mark R. DeLuca

(57) ABSTRACT

A device configured to assist the performance of upper body exercises by a subject includes a base, the base comprising a cut-out having a shape complementary with a portion of a support member and a platform, couplable to the base, wherein the platform has a cut-out having a shape complementary with a portion of the support member. When the platform is coupled to the base, the cut-out on the platform aligns with the cut-out on the base.

12 Claims, 4 Drawing Sheets

FRONT LEANING REST PLATFORMS AND USE THEREOF

PRIORITY CLAIM

This application claims priority to U.S. Provisional Application Ser. No. 62/466,466 entitled "Front Leaning Rest Platforms And Use Thereof" filed Mar. 3, 2017, which is incorporated herein by reference in its entirety.

BACKGROUND OF THE INVENTION

1. Field of the Invention

The invention generally relates to equipment and techniques for rehabilitation from injuries.

2. Description of the Relevant Art

People sustain upper body injuries from a variety of causes resulting in physical limitations that require rehabilitation. Examples of causes of upper body injuries include but are not limited to falls, automobile accidents, and sports activities. People with upper body injuries often undergo rehabilitation for their injuries. One of the rehabilitation techniques involves push-ups.

SUMMARY OF THE INVENTION

An exercise device is described that assists rehabilitation by allowing the patient to use the correct muscles for push-ups. The exercise device attaches to a support member (e.g., a rod such as a barbell) securely allowing the patient to perform push-ups at various angles while using the correct muscles.

The exercise device comprises an interlocking base and platform. An optional locking pin can be used to inhibit separation of the base from the platform. Both the base and the platform have cut outs that are aligned when the base and platform are assembled together. The cutouts have a shape that, when the cut outs are aligned, is complementary to the shape of the support member. The cut outs may be lined with a friction surface to improve the grip of the platform onto the support member. The outer surface of the platform is roughened to improve the grip of the subject with the platform and to simulate various surfaces that push-ups are usually performed on (e.g., ground or cement/concrete).

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
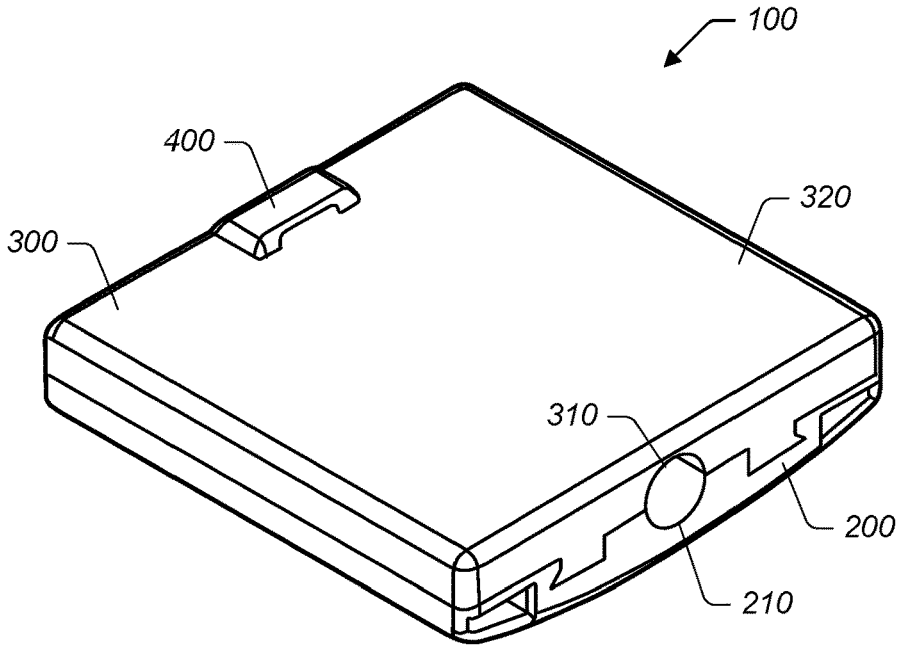
FIG. 1 depicts a projection view of an exercise device configured to assist the performance of upper body exercises by a subject.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

FIG. 1 depicts a projection view of an exercise device 100 configured to assist the performance of upper body exercises by a subject. The device includes a base 200, the base comprising a cut-out 210 having a shape complementary with a portion of a support member (not depicted). In the embodiment depicted in FIG. 1, the support member has a circular cross-section, however it should be understood that the support member may have other cross-section shapes (e.g., oval, square, rectangular, etc.). The device also includes a platform 300, couplable to base 200. The platform 300 has a cut-out 310 having a shape complementary with a portion of the support member.

Figure 2:
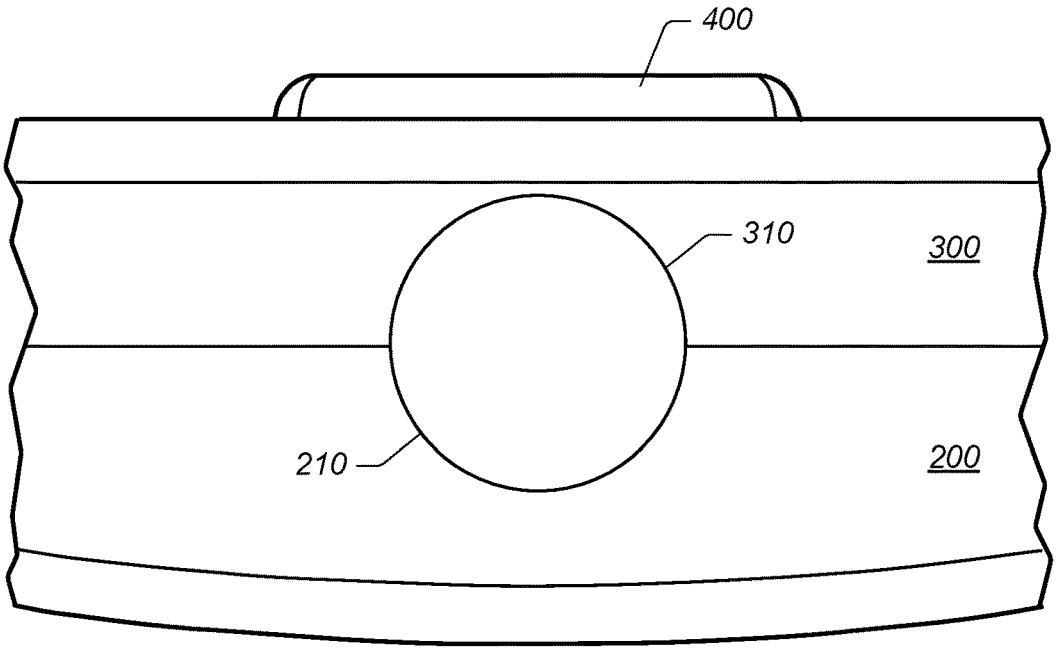
FIG. 2 depicts an end view of the exercise device of FIG. 1.
Figure 3A:
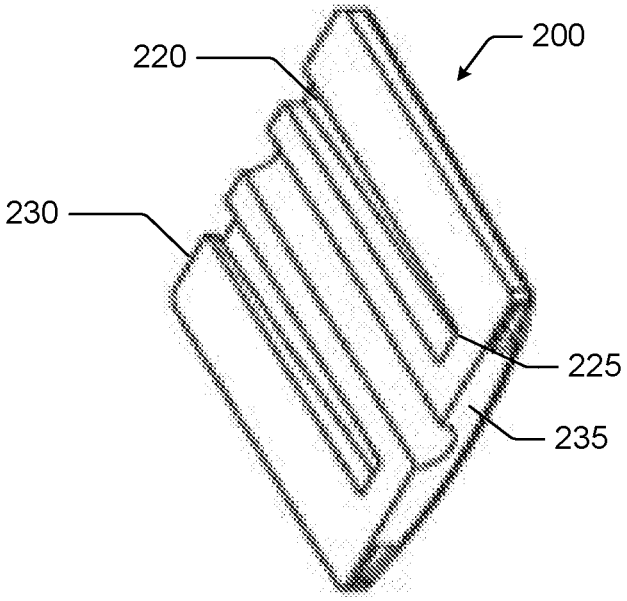
FIGS. 3A-3D depict projection, side, top and end views, respectively, of a base of an exercise device.
Figure 3B:
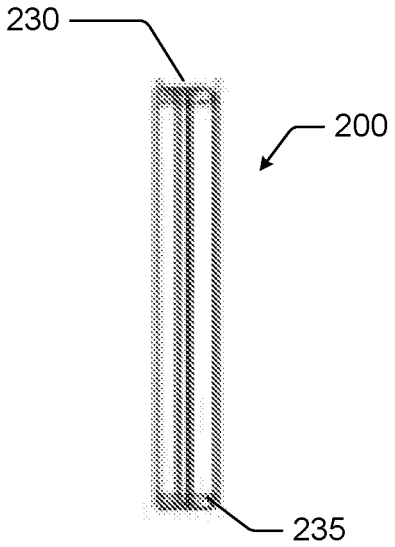
Figure 3C:
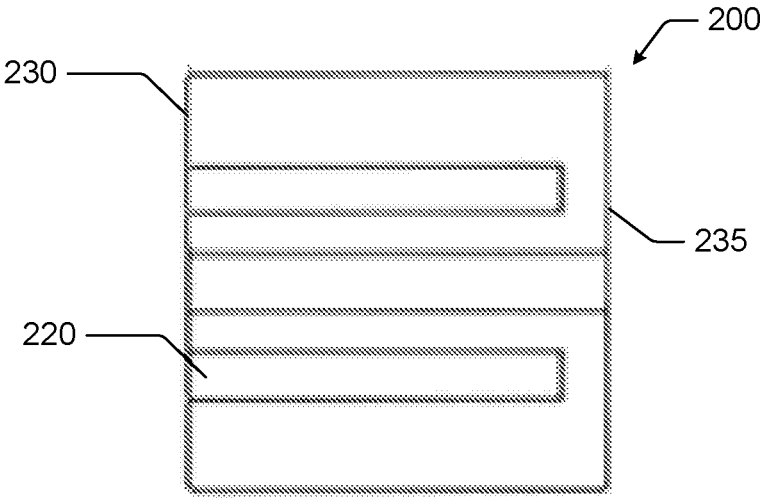
Figure 3D:
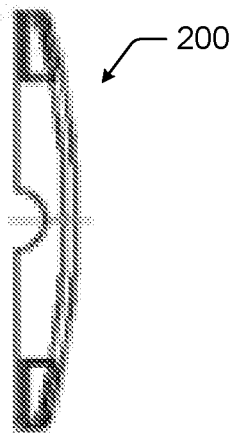

FIG. 2 depicts an end view of exercise device 100. As shown in more detail in FIG. 2, when the platform 300 is coupled to base 200, the cut-out on the platform 310 aligns with the cut-out on the base 210 to form a complete shape that is complimentary to the shape of a support member. Specifically, in this particular embodiment, the exercise device is intended to be coupled to a bar of a barbell. When the platform is coupled to the base, the cut-outs are aligned to form a circular opening that is complementary to the circular cross-sectional shape of the bar of the barbell. In an embodiment, cut-out 210 of the base and/or cut-out 310 of the platform is lined with a material that increases the friction between the respective cut-out and the support member.

In some embodiment, the exercise device further comprises a locking pin 400 coupleable to the base and the platform, wherein the locking pin inhibits separation of the base from the platform. Locking pin 400, in some embodiments, extends through an opening in the platform into the base. Alternatively, locking pin 400 may extend through an opening in the base into the platform. In either embodiment, locking pin 400 inhibits a sliding motion of the platform with respect to the base. In other embodiments, locking pin 400 inhibits the platform from being pulled away from the base.

Outer surface 320 of platform 300 may have a roughened surface. The outer surface may be roughed to improve the grip of the subject with the platform. Also, the outer surface may be roughened to simulate a surface that the subject may normally use for the upper body exercise, such as cement/concrete, hard wood floors, etc.

In one embodiment, the base or the platform includes one or more grooves and the other of the base or the platform comprises one or more locking members having a shape complementary to the one or more grooves. The locking member is positionable in the grove when the base is coupled to the platform.

FIGS. 3A-3D depict projection, side, top and end views, respectively, of base 200 of exercise device 100. In this particular embodiment, base 200 includes two grooves 220 which extend from a first end 230 toward a second end 235. Grooves 220 end before reaching second end 240. This creates a stop 225 which prevents a complementary feature from the platform from sliding past second end 235 of the base.

Figure 4A:
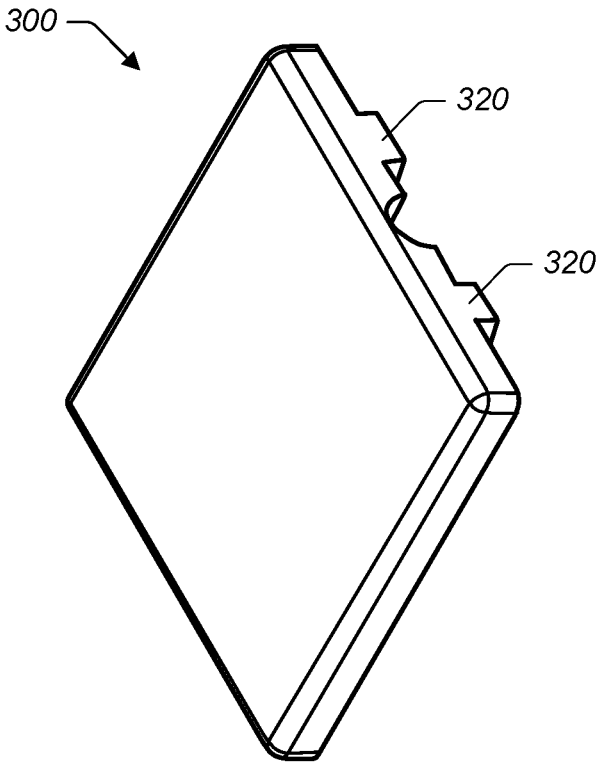
FIGS. 4A-4D depict projection, end, top and side views respectively, of a platform of an exercise device.
Figure 4B:
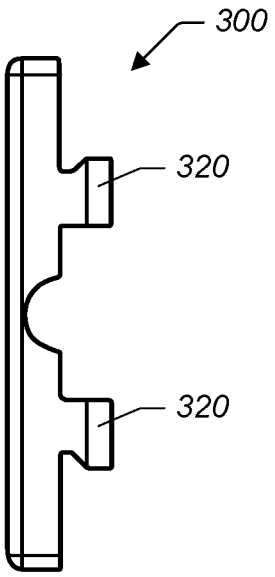
Figure 4C:
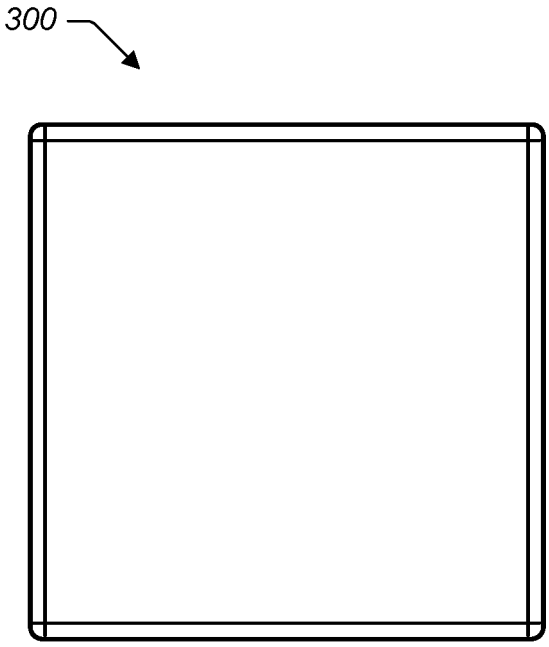
Figure 4D:
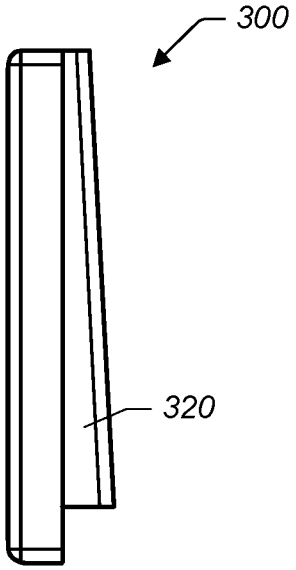

FIGS. 4A-4D depict projection, end, top and side views respectively, of platform 300 which includes locking member 320, which are complementary with grooves 220 of the base. In this particular embodiment, the platform includes two locking members 320, which fit into each of the two grooves 220 when the base is coupled to the platform. As depicted in FIG. 4D, locking members may have a tapered side view. When using tapered locking members 320 the grooves 220 of base 200 may also have a complementary taper.

Figure 5:
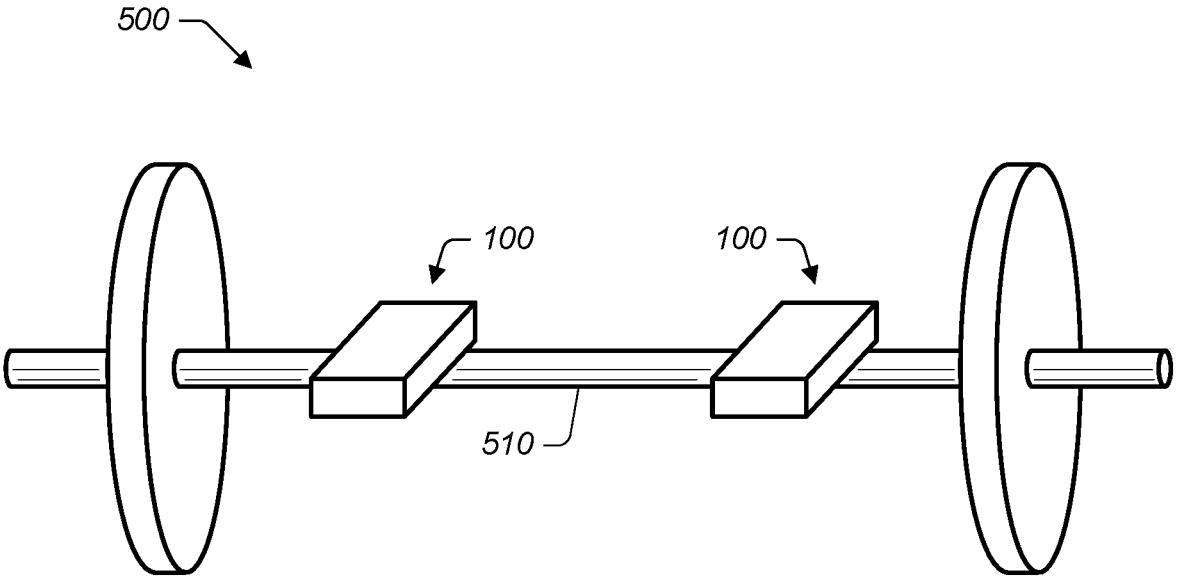
FIG. 5 depicts a pair of exercise devices coupled to a bar of a barbell.

Prior to use by a subject, the exercise device 100 is coupled to a support member. In one embodiment, the support member is a bar of a standard barbell, as depicted in FIG. 5. When used on a bar of a standard barbell, cut-outs 210/310 together form a circular opening through the exercise device that has a diameter that is approximately equal to the diameter of the bar of the barbell. In one embodiment, exercise device 100 is placed onto a bar 510 of a barbell 500 by first positioning base 200 against a portion of bar 510. With base 200 being held against bar 510, platform 300 is positioned proximate to base 200 against bar 510. With platform 300 resting against bar 510, the platform is slid onto base 200, when locking members 320 are substantially aligned with grooves 220 of the base. Platform 300 is slid onto base 200 until locking members 320 contact stops 225 of base. At this point, platform 300 is substantially aligned with base 200. A locking pin 400 may be inserted into the appropriate opening on base 200 or platform 300 to lock the platform to the base by inhibiting the platform from sliding with respect to the base.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An exercise device configured to assist the performance of upper body exercises by a subject comprising:

a base, the base comprising a cut-out having a shape complementary with a portion of a support member;

a platform, couplable to the base, wherein the platform has a cut-out having a shape complementary with a portion of the support member;

wherein, when the platform is coupled to the base, the cut-out on the platform aligns with the cut-out on the base;

wherein, during use, the platform and base, together, surround the support member, wherein the support member is a bar of a barbell; and wherein the platform has a shape and size configured to contact all of a hand of the subject during use of the exercise device.

2. The exercise device of claim 1, wherein the base or the platform comprises one or more grooves and the other of the base or the platform comprises one or more locking members having a shape complementary to the one or more grooves, wherein the one or more locking members are positionable in the one or more groves when the base is coupled to the platform.

3. The exercise device of claim 2, wherein the one or more locking members slide into the one or more grooves when the base is coupled to the platform.

4. The exercise device of claim 1, further comprising a locking pin coupleable to the base and the platform, wherein the locking pin inhibits separation of the base from the platform.

5. The exercise device of claim 1, wherein an outer surface of the platform is formed from a roughened surface.

6. The exercise device of claim 1, wherein the cut-out of the base and/or the cut-out of the platform is lined with a material that increases friction between the respective cut-out and the support member.

7. A method of performing upper body exercises by a subject, comprising:

attaching an exercise device to a support member, wherein the exercise device comprises:

a base, the base comprising a cut-out having a shape complementary with a portion of a support member;

a platform, couplable to the base, wherein the platform has a cut-out having a shape complementary with a portion of the support member;

wherein, when the platform is coupled to the base, the cut-out on the platform aligns with the cut-out on the base;

wherein, during use, the platform and base, together, surround the support member, wherein the support member is a bar of a barbell; and wherein the platform has a shape and size configured to contact all of a hand of the subject during use of the exercise device; and having the subject perform an upper body exercise while one or both hands of the subject are resting on the exercise device.

8. The method of claim 7, wherein the base or the platform comprises one or more grooves and the other of the base or the platform comprises one or more locking members having a shape complementary to the one or more grooves, wherein the one or more locking members are positionable in the one or more groves when the base is coupled to the platform.

9. The method of claim 8, wherein the one or more locking members slide into the one or more grooves when the base is coupled to the platform.

10. The method of claim 7, wherein the exercise device further comprises a locking pin coupleable to the base and the platform, wherein the locking pin inhibits separation of the base from the platform.

11. The method of claim 7, wherein an outer surface of the platform is formed from a roughened surface.

12. The method of claim 1, wherein the cut-out of the base and/or the cut-out of the platform is lined with a material that increases friction between the respective cut-out and the support member.

* * * * *